US009834920B2

(12) United States Patent
Priester

(10) Patent No.: US 9,834,920 B2
(45) Date of Patent: Dec. 5, 2017

(54) PLASTIC FLOOR DRAIN

(71) Applicant: Jay R. Smith Mfg. Co., Montgomery, AL (US)

(72) Inventor: Donald Elwyn Priester, Deatsville, AL (US)

(73) Assignee: Jay R. Smith Manufacturing Company, Montgomery, AL (US)

( * ) Notice: Subject to any disclaimer, the term of this patent is extended or adjusted under 35 U.S.C. 154(b) by 44 days.

(21) Appl. No.: 14/757,099

(22) Filed: Nov. 18, 2015

(65) Prior Publication Data

US 2017/0138036 A1 May 18, 2017

(51) Int. Cl.
*E03F 5/04* (2006.01)
*E03C 1/26* (2006.01)

(52) U.S. Cl.
CPC ..... *E03F 5/0407* (2013.01); *E03C 1/26* (2013.01)

(58) Field of Classification Search
CPC ..... E03F 5/0407; E03F 5/0408; E03F 5/0409; E03C 1/22; E03C 1/26; E03C 1/264; A47K 3/40; A47K 3/405
USPC ..... 210/163, 164, 165; 52/302.1; 4/286, 4/290, 291, 292, 613, 679
See application file for complete search history.

(56) References Cited

U.S. PATENT DOCUMENTS 1,601,498 A * 9/1926 Hirshstein ..... F16J 13/06 210/163
2,749,999 A * 6/1956 Schmid ..... E03F 5/0407 210/165
2,779,430 A 1/1957 Sisk
3,246,582 A * 4/1966 Wade ..... E03F 5/0407 210/164
3,921,661 A 11/1975 Emberson
4,321,713 A * 3/1982 Thompson ..... E03C 1/26 4/286
4,730,854 A 3/1988 Cuschera
4,910,811 A 3/1990 Ixzi
5,263,746 A 11/1993 Cornwall
5,293,724 A 3/1994 Cornwall
6,537,448 B2 * 3/2003 Houk ..... E03C 1/18 210/164

(Continued)

*Primary Examiner* — Christopher Upton
(74) *Attorney, Agent, or Firm* — Eric J. Sosenko; Jonathan P. O'Brien; Honigman Miller Schwartz and Cohn LLP

(57) ABSTRACT

Embodiments include plastic floor drains or sinks. Embodiments also include plastic floor drain which comprises an approximately square receptor having an open top with a notch and a rim at the open top, an outlet at the bottom, and four sides. Each side has a shoulder located along the width of each side at approximately ⅓ the distance from the top to the bottom of the body. Embodiments also include a plastic floor drain which comprises an approximately square receptor having an open top with a notch and a rim at the open top, an outlet at the bottom, and four sides. Each side has a shoulder having a bottom side and located along the width of each side at approximately ⅓ the distance from the top to the bottom of the receptor. There are a multiplicity of seepage holes in the receptor arrayed along the top sides of the shoulders. A four-sided anchor flange is adhesively connected to the shoulder. A flashing clamp is attached by connectors to each side of the flashing clamp, each flashing clamp being capable of retaining a membrane between the anchor flange side and the flashing clamp.

20 Claims, 6 Drawing Sheets

(56) References Cited

U.S. PATENT DOCUMENTS

| | | | | |
|---|---|---|---|---|
| 8,347,906 | B1 | 1/2013 | Ismert et al. | |
| 8,628,657 | B1 * | 1/2014 | Robillard | E03F 5/0407 210/163 |
| 2007/0177942 | A1 * | 8/2007 | Meyers | E03F 5/0408 405/40 |
| 2008/0017562 | A1 * | 1/2008 | Tripodi | E03F 5/0407 210/163 |
| 2008/0308476 | A1 | 12/2008 | Silverstein et al. | |
| 2012/0037553 | A1 | 2/2012 | Silverstein et al. | |
| 2012/0199216 | A1 | 8/2012 | Sdhramer | |

* cited by examiner

PLASTIC FLOOR DRAIN

BACKGROUND OF THE INVENTION

Field of the Invention

Embodiments relate to sinks or drains which treat water or waste liquid which include a strainer, are located on a floor with the strainer level with the floor, and with provisions for disposal of subsurface waste.

Current examples of plastic floor drains are inflexible in that they are configured in the process of manufacture, and cannot be adjusted to varying requirements existing at the site of installation in buildings during construction. Such inflexibility increases inventory costs and causes delays in building construction.

The foregoing examples of the related art and limitations related therewith are intended to be illustrative and not exclusive. Other limitations of the related art will become apparent to those of skill in the art upon a reading of the specification and a study of the drawings.

Embodiments of the present disclosure provide plastic floor drains which are inexpensive and flexible and facilitate installation under varying conditions. Embodiments, through the use of common parts, reduce the costs and labor involved in providing a variety of floor drains to meet divergent requirements.

BRIEF SUMMARY OF THE INVENTION

The following embodiments and aspects thereof are described and illustrated in conjunction with systems, tool and methods which are meant to be exemplary and illustrative, not limiting in scope. In various embodiments, one or more of the above—described problems have been reduced or eliminated, while other embodiments are directed to other improvements.

Embodiments include plastic floor drain which comprises an approximately square receptor having an open top with a notch and a rim at the open top, an outlet at the bottom, and four sides. Each side has a shoulder located along the width of each side at approximately ⅓ the distance from the top to the bottom of the body.

Embodiments include a plastic floor drain which comprises an approximately square receptor having an open top with a notch and a rim at the open top, an outlet at the bottom, and four sides. Each side has a shoulder having a bottom side and located along the width of each side at approximately ⅓ the distance from the top to the bottom of the receptor. There are a multiplicity of seepage holes in the receptor arrayed along the top sides of the shoulders. A four-sided anchor flange is adhesively connected to the shoulder. A flashing clamp is attached by connectors to each side of the flashing clamp, each flashing clamp being capable of retaining a membrane between the anchor flange side and the flashing clamp.

In addition to the exemplary aspects and embodiments described above, further aspects and embodiments will become apparent by reference to the drawings and by study of the following descriptions.

DETAILED DESCRIPTION OF THE INVENTION

Figure 1:
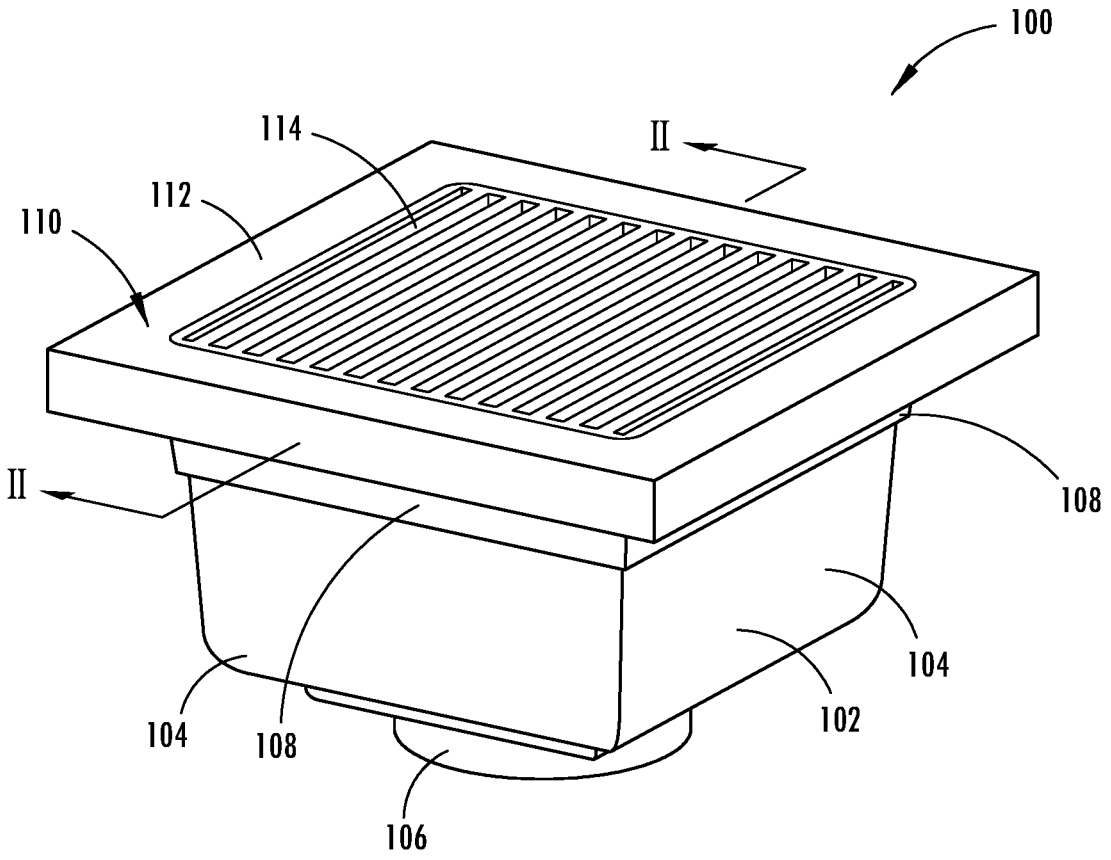
FIG. 1 is a perspective view of a first embodiment plastic floor drain 100.

FIG. 1 is a perspective view of a first embodiment plastic floor drain 100. Visible in FIG. 1 is a square receptor 102 with four sides 104. Each side 104 has a shoulder or ridge 108 located along the width of each side at approximately ⅓ the distance from the top to the bottom of the receptor. Also visible is a overlying grate 110 comprised of an overlying grate rim 112 and overlying grate mesh 114.

Figure 2:
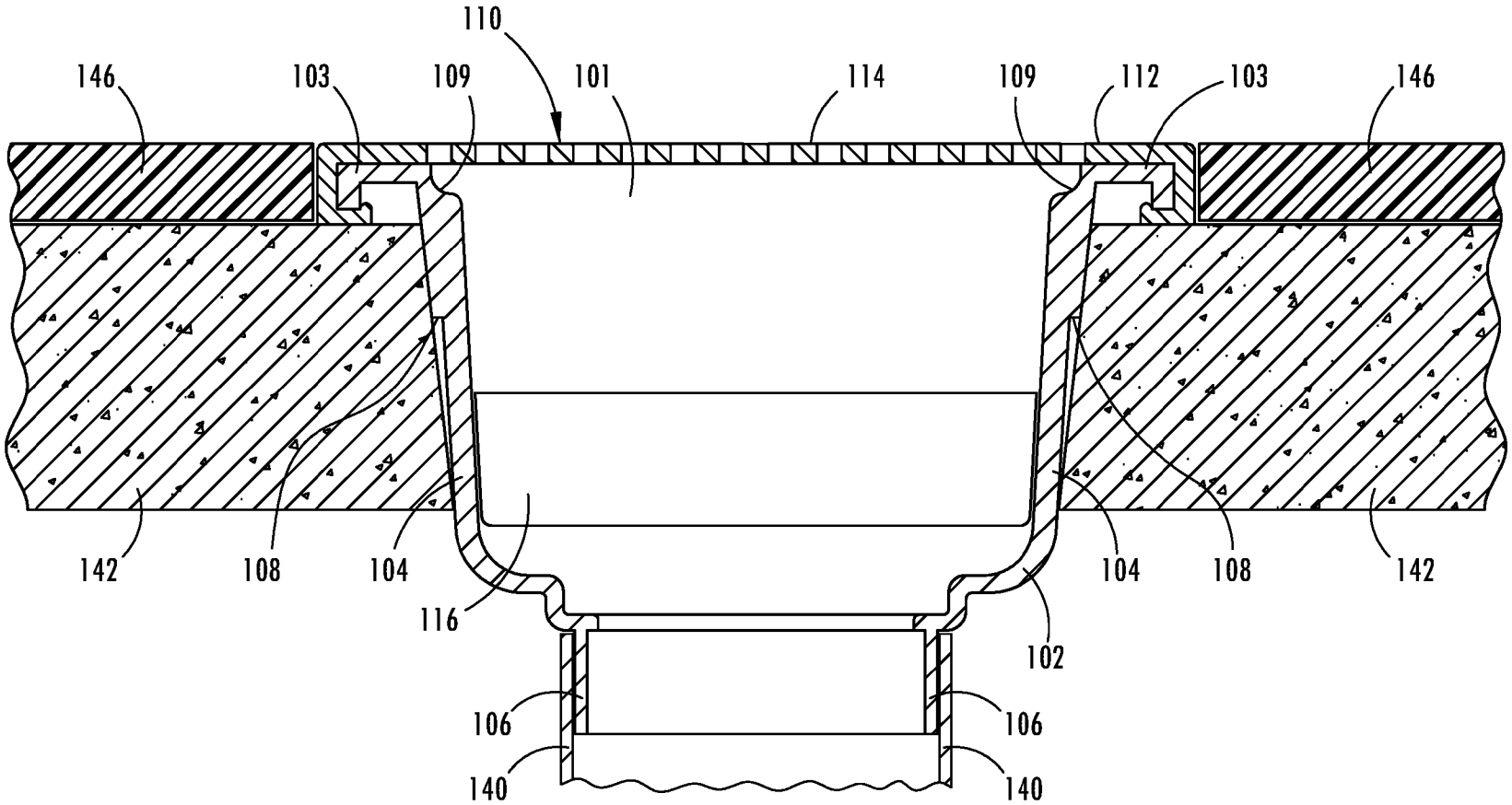
FIG. 2 is a cross-sectional view of a first embodiment plastic floor drain taken at line 2-2 of FIG. 1.

FIG. 2 is a cross-sectional view of a first embodiment plastic floor drain taken at line 2-2 of FIG. 1. Visible in FIG. 2 is a receptor 102, receptor sides 104, a shoulder 108 on each receptor side 104, a notch at the top of each receptor side, and a rim 103 at the top of each receptor side. An open top 101 is at the top of the receptor 102. Also visible in FIG. 2 is an overlying grate 110 with an overlying grate rim 112 and a overlying grate mesh 114. A square sediment tray strainer 116 with holes in the bottom (not shown in FIG. 2) is located at the bottom of the receptor. A slip outlet 106 at the very bottom of the receptor is shown inserted into a drain pipe 140.

The first embodiment plastic floor drain of FIG. 2 is shown embedded in a concrete floor. Visible in FIG. 2 is the structural concrete pour 142 and tiles 146 or other floor coverings on top of the structural concrete.

Figure 3:
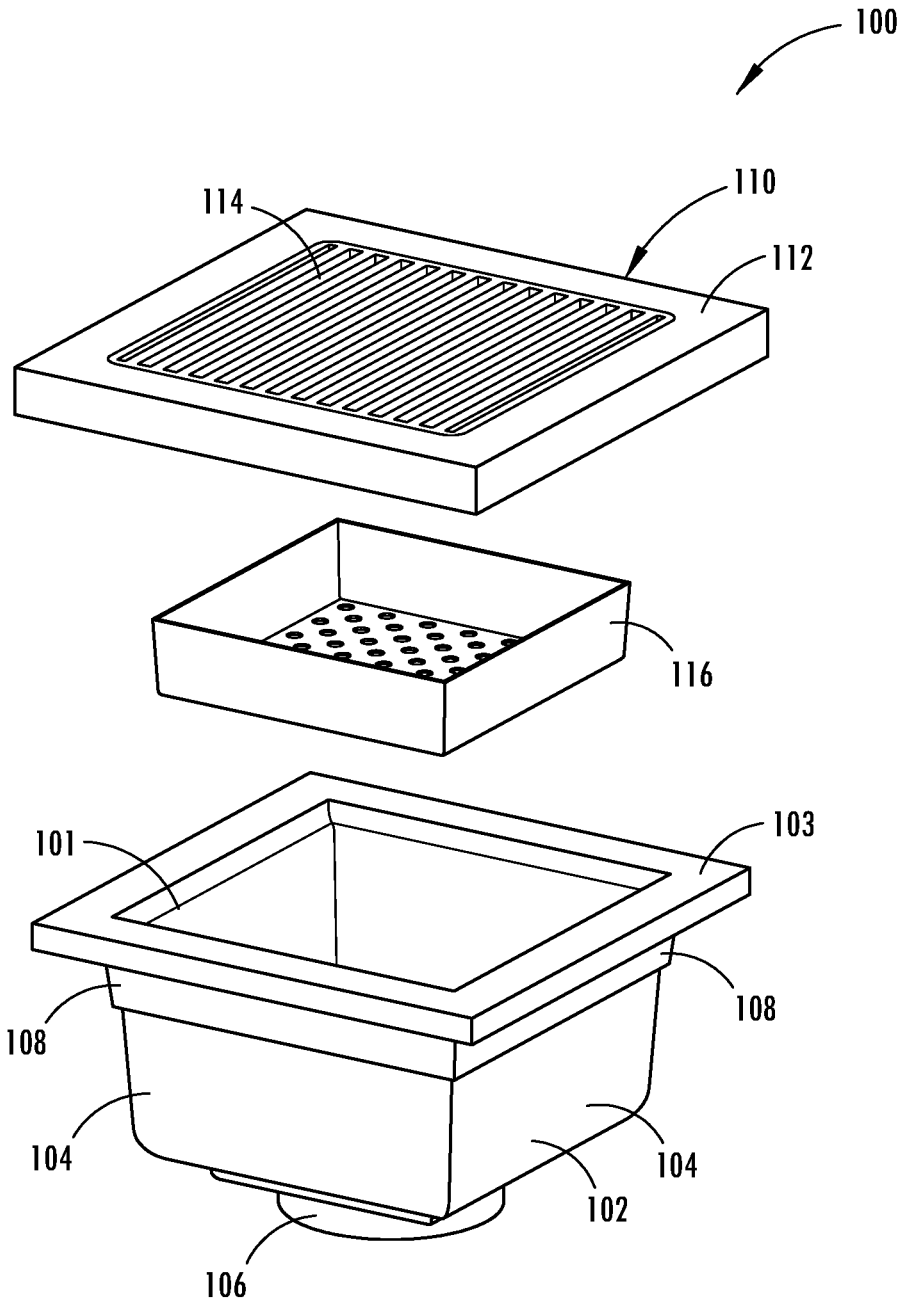
FIG. 3 is an exploded view of a first embodiment plastic floor drain.

FIG. 3 is an exploded view of a first embodiment plastic floor drain. The elements shown in FIG. 3 are the same as those shown in FIG. 2.

Figure 4:
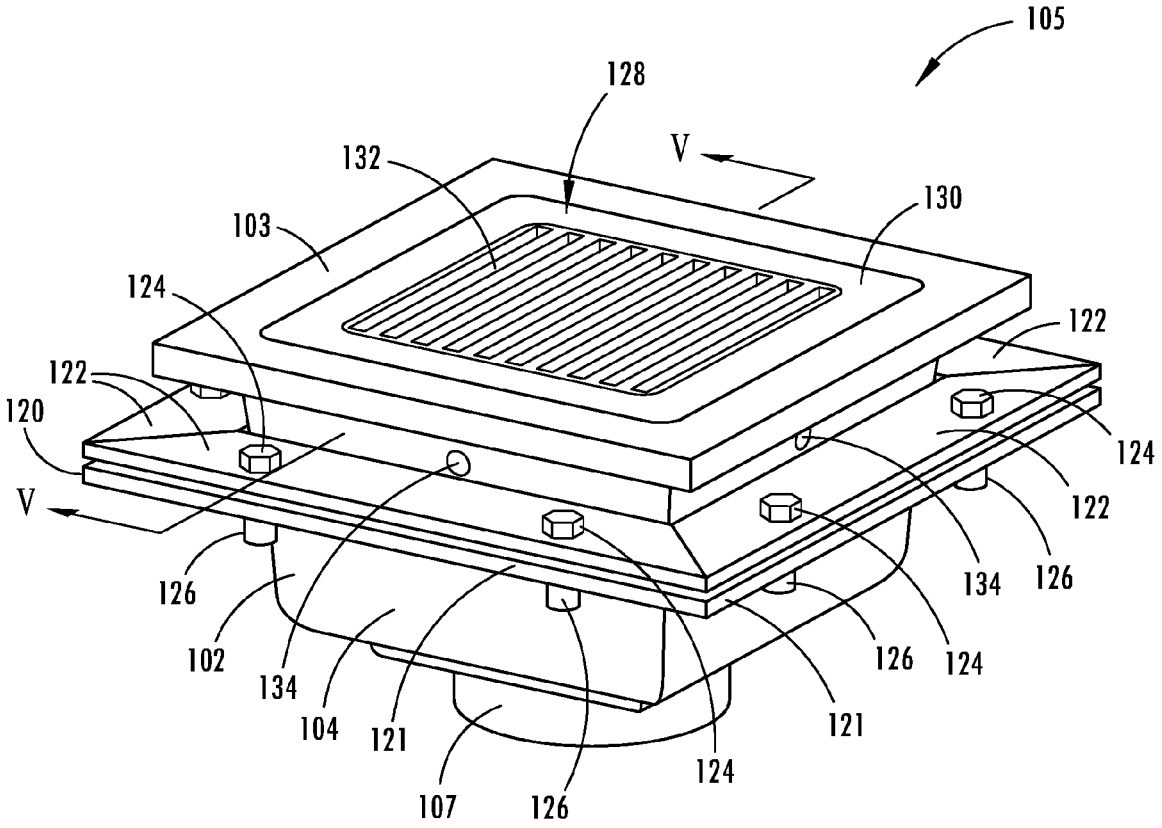
FIG. 4 is a perspective view of a second embodiment plastic floor drain.

FIG. 4 is a perspective view of a second embodiment plastic floor drain. Visible in FIG. 4 is the receptor 102, one receptor side 104, a hub outlet 107, receptor rim 103, a portion of the square flange 120 comprised of four rectangular flange arms 121, two of which are visible in FIG. 4. Also visible are the four flashing clamps 122 and the bolts 124 which connect the flashing clamps 122 to the flashing arms 121. Weep holes 134 are seen in the receptor sides 104. Flange bold sockets 126 protrude below the flange arms 121.

The embodiment of FIG. 4 includes an inserting grate 128, which is comprised of an inserting grate rim 130 and inserting grate mesh 132.

Figure 5:
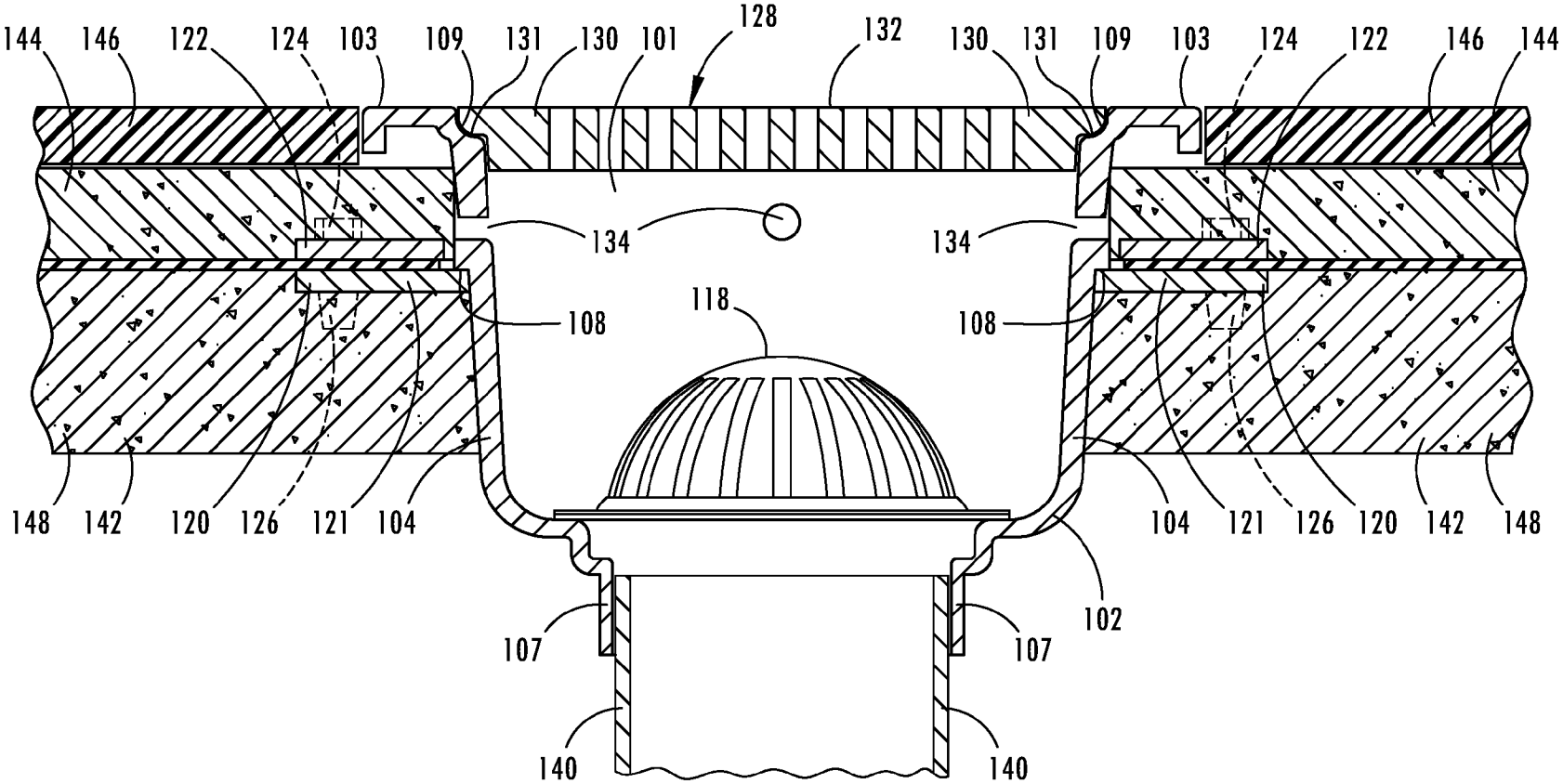
FIG. 5 is a cross-sectional view of a second embodiment plastic floor drain taken at line 5-5 of FIG. 4.

FIG. 5 is a cross-sectional view of a second embodiment plastic floor drain taken at line 5-5 of FIG. 4. Elements 101-104 and 107-109 in the second embodiment are the same as those shown in FIG. 2 as elements of the first embodiment. This second embodiment differs from the disclosed first embodiment primarily in the addition of the square flange 120 with four rectangular flange arms 121. Flashing clamps 122 are capable of attachment to the flange arms 121 by flashing clamp bolts 124. The flange 120 is attached to the shoulder or ridge 108 by an adhesive. This attachment may be done by the manufacturer or by the user in the field before the drain is installed. Also visible in FIG. 5 are seep holes 134. The seep holes may be made by the manufacturer or by the user by drilling through the receptor walls 104 at points indicated by markings on the flange arms 121.

In FIG. 5 the second embodiment plastic floor drain is shown installed in an above grade building floor. Visible in FIG. 5 is the structural concrete pour 142, an overlying water impervious membrane 148, the secondary lightweight concrete pour 144 and the tile 146 finishing surface of the floor. The membrane 148 covers the structural concrete pour 142 with a square hole cut in it to accommodate the second embodiment plastic floor drain 105. The edges of the membrane 148 are sealed by clamping between the flange arms 121 and the flashing clamps 122. Any moisture which penetrates the finish tiles 146 and the secondary concrete pour 144 is conveyed by the membrane 148 through the weep holes 134 where it enters the drain pipe 140.

In the second embodiment shown in FIG. 5 an inserting grate 128 is shown with a inserting grate rim 130 which has an inserting grate rim ear 131 which rests on the notch 109 at the top of the receptor walls 104. In the second embodiment the inserting grate 128 is interchangeable with the overlying grate (110 in FIG. 2) of the first embodiment. Also visible in FIG. 5 is the hub outlet 107 at the bottom of the receptor which fits on the outside of the drain pipe 140. In the second embodiment the hub outlet 107 is interchangeable with the hub outlet (107 in FIG. 2) of the first embodiment. Also, in the second embodiment the dome strainer 118 is interchangeable with the sediment tray strainer (116 in FIG. 2) of the first embodiment.

Figure 6:
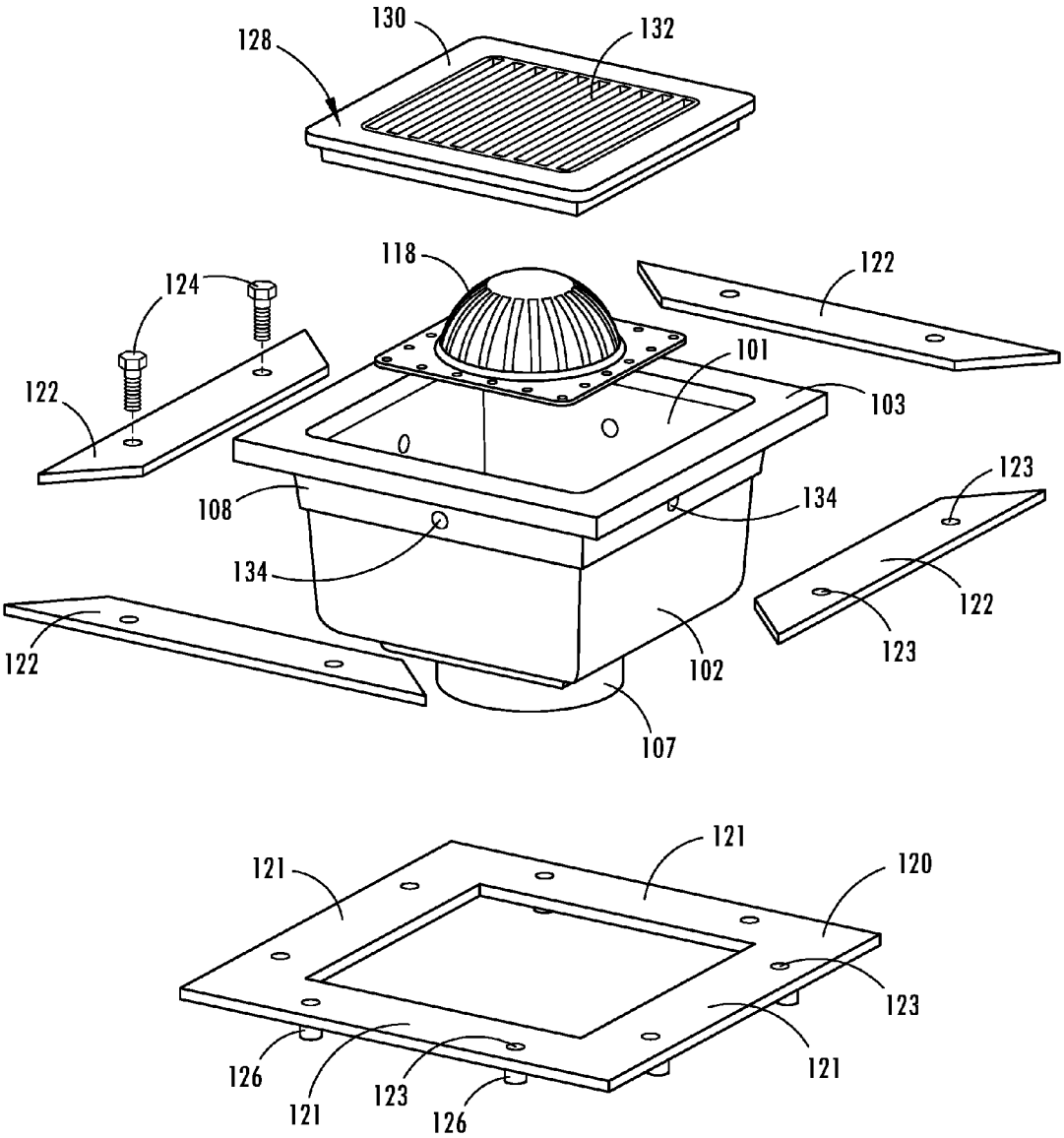
FIG. 6 is an exploded view of a second embodiment plastic floor drain.

FIG. 6 is an exploded view of a second embodiment plastic floor drain. The elements of FIG. 6 are the same as those of FIG. 5. In addition, FIG. 6 shows flashing clamp bolt holes 123 in the flashing clamps and in the arms 121 of the flange 120.

The first embodiment plastic floor drains are typically installed in on grade applications, for example, in a basement, where there is only one concrete pour. This minimizes the expense of the plastic floor drains. The shoulder provides structural stability to the drain against forces directed to the top of the drain.

The second embodiment plastic floor drains are typically installed in above grade applications, above the lowest floor. The receptor is embedded in the structural concrete pour, typically four inches thick. A waterproof membrane is placed on the structural concrete slab. A secondary pour of concrete, generally lightweight concrete is placed on the membrane. Tiles or other finishing material completes the floor installation. The floor sink represents a penetration of the membrane as a portion of the membrane to accommodate the drain is removed. The penetration represented by the sink is sealed by clamping the membrane to the sink by using flashing clamps on all sides. The use of weep holes in the receptor above the installed flange allows water or other fluids which penetrate the finishing material and the secondary pour concrete to enter the drain and be removed rather than seeping to other floors.

In the second embodiment plastic floor drains the flange serves a second structural function. Forces on a floor drain are exerted from above, at the top of the drain. The flange provides structural stability against such forces and positively locks the drain in place in the floor.

Although only a single first and a single second embodiments are shown in the Figs., it should be noted that there a large number of possible embodiments are included in the category of first and second embodiments.

Although a dome strainer is shown with a first embodiment and a sediment tray with a second embodiment, it should be noted that any strainer may be used with any embodiment. Although a slip outlet is shown with a first embodiment and a hub outlet with second embodiment, it should be noted that any outlet may be used with any embodiment. Although an overlying grate is shown with a first embodiment and an inserting grate with a second embodiment, it should be noted that any grate may be used with any embodiment.

In embodiments the plastic floor drain receptors, flanges, flashing clamps grates and strainers are manufactured of any suitable hard, strong, resilient, impervious plastic. Suitable plastic polymers include polyvinyl chloride (PVC) and acrylonitrile butadiene styrene (ABS). In embodiments, the plastic floor drain can be used with fluids at temperatures from −13° F. to 200° F. In embodiments, the receptor rim is coated with nickel bronze. In embodiments, the grate is manufactured from acid resistant coated cast iron.

Any strong resilient water impervious material may be used as the membrane. In embodiments, the membrane is manufactured of plastic, rubber, lead, or tar paper.

Any suitable strong adhesive may be used to attach the flange to the receptor. Suitable adhesives include PVC solvents when PVC is the material of manufacture of the receptor and of the flange; and ABS solvents when ABS is the material of manufacture of the receptor and of the flange. In embodiments the adhesive used to attach the flange is the same adhesive used in other plumbing on the building, for example, in connecting pipes or connecting the plastic floor drain to the outlet pipe. This minimizes the expense in installing the plastic floor drain.

In embodiments, the receptor rim is 12 inches from side to side. In embodiments the height of the drain is 8¼ inches from the top of the grate rim to the bottom of the outlet. In embodiments, the flange is 14 inches from one side to the other.

The use of common parts, the receptors, strainers, grates and outlets, in the first and second embodiments has a number of advantages. It minimizes the inventory expense for the manufacturer, wholesalers, and users who install the drains in buildings. It provides flexibility to the user, whose requirements may change as buildings progresses.

While a number of exemplary aspects and embodiments have been discussed above, those of skill in the art will recognize certain modifications, permutations, additions and sub combinations thereof. It is therefore intended that the following appended claims and claims hereafter introduced are interpreted to include all such modifications, permutations, additions and sub-combinations as are within their true spirit and scope. The applicant or applicants have attempted to disclose all the embodiments of the invention that could be reasonably foreseen. There may be unforeseeable insubstantial modifications that remain as equivalents.

I claim:

1. A plastic floor drain comprising:

an approximately square receptor having an open top with a notch and a rim at the open top, an outlet at the bottom, and four sides, each side having a shoulder with a bottom side and located along the width of each side at approximately ⅓ the distance from the top to the bottom of the body, a multiplicity of seepage holes in the receptor arrayed along the top of the shoulders, a four-sided anchor flange adhesively connected to the shoulder, and a flashing clamp attached by connectors to each side of the anchor flange, each flashing clamp capable of retaining a membrane between the anchor flange side and the flashing clamp.

2. The plastic floor drain of claim 1 further comprising:

a membrane retained between the flashing clamps and the anchor flange, the membrane being selected from the group of membranes consisting of plastic membranes, rubber membranes, lead membranes, and tar paper membranes.

3. The plastic floor drain of claim 1 further comprising: a grate located at the top of the receptor, the grate sitting on and being retained by attachment to the open top rim or the grate fitting into the open top and being retained by the notch.

4. The plastic floor drain of claim 1 further comprising:

a strainer located in the body above the outlet, the strainer being one of a dome bottom strainer or a sediment tray strainer.

5. The plastic floor drain of claim 1 wherein the connectors are bolts.

6. The plastic floor drain of claim 1 wherein the outlet is a hub outlet or a slip outlet.

7. The plastic floor drain of claim 1 wherein the rim is coated with nickel bronze.

8. The plastic floor drain of claim 1 wherein the receptor is manufactured of a plastic chosen from the group of plastics consisting of polyvinyl chloride and acrylonitrile butadiene styrene.

9. The plastic floor drain of claim 1 wherein the adhesive is selected from the group of adhesives consisting of a polyvinyl chloride solvent and a acrylonitrile butadiene styrene solvent.

10. A floor drain assembly comprising:

a receptor having a side wall, a top and a bottom, the top being open and including peripheral rim, the bottom being closed and including an outlet defined therein;

a grate located at the top of the receptor;

a shoulder extending around the receptor on the side wall;

an anchor flange configured to be attached to the shoulder and extend outward therefrom; and a flashing clamp configured to be secured to the anchor flange and to retain a membrane between the flashing clamp and the anchor flange.

11. The floor drain assembly of claim 10, wherein the flashing clamp is secured to the anchor flange by mechanical fasteners.

12. The floor drain assembly of claim 10, wherein the outlet defines an axis extending through the receptor and the shoulder includes an axially facing bottom surface, the anchor flange being configured to attach to the bottom surface of the shoulder and extend radially outward of the shoulder.

13. The floor drain assembly of claim 12, wherein the anchor flange is configured to be attached to the shoulder by an adhesive.

14. The floor drain assembly of claim 13, wherein the receptor is formed of a plastic material, the plastic material being one of polyvinyl chloride or acrylonitrile butadiene styrene, and wherein the adhesive is one of a polyvinyl chloride solvent and a acrylonitrile butadiene styrene solvent.

15. The floor drain assembly of claim 10, further comprising a plurality of seepage holes formed in the sidewall of the receptor, the seepage holes being located between the shoulder and the top of the receptors.

16. The floor drain assembly of claim 10, wherein the seepage holes are adjacent to the shoulder.

17. The floor drain assembly of claim 10, wherein the anchor flange is a one-piece component.

18. The floor drain assembly of claim 10, wherein the flashing clamp is a multi-piece component.

19. The floor drain assembly of claim 10, wherein the receptor is multi-sided, and wherein the anchor flange is a one-piece component having multiple sides.

20. The floor drain assembly of claim 19, wherein the flashing clamp is a multi-piece component.

* * * * *